United States Patent [19]

Iwai et al.

[11] Patent Number: 4,926,645

[45] Date of Patent: May 22, 1990

[54] COMBUSTOR FOR GAS TURBINE

[75] Inventors: Kazumi Iwai, Mito; Hiromi Koizumi; Katsuo Wada, both of Hitachi, all of Japan

[73] Assignee: Hitachi, Ltd., Tokyo, Japan

[21] Appl. No.: 387,146

[22] Filed: Jul. 31, 1989

Related U.S. Application Data

[63] Continuation of Ser. No. 91,752, Sep. 1, 1987.

[30] Foreign Application Priority Data

Sep. 1, 1986 [JP] Japan ..... 61-203747

[51] Int. Cl.[5] ..... F23R 3/40; F23R 3/34

[52] U.S. Cl. ..... 60/723; 60/746

[58] Field of Search ..... 60/723, 732, 733, 746; 431/7, 328, DIG. 1; 422/171

[56] References Cited

U.S. PATENT DOCUMENTS 4,202,168 5/1980 Acheson et al. ..... 60/723
4,285,193 8/1981 Shaw et al. ..... 60/723
4,375,949 3/1983 Salooja ..... 431/DIG. 1
4,726,181 2/1988 Pillsbury ..... 431/7

FOREIGN PATENT DOCUMENTS 195215 8/1986 Japan .
2023266 12/1979 United Kingdom .

*Primary Examiner*—Louis J. Casaregola
*Assistant Examiner*—Timothy S. Thorpe
*Attorney, Agent, or Firm*—Antonelli, Terry, Stout & Kraus

[57] ABSTRACT

A catalytic combustor for a gas turbine comprises catalyst layers arranged in two stages in a direction of gas flow. Fuel supply nozzles are disposed close to and upstream of the downstream catalyst layer. A substantially constant amount of fuel is supplied from the fuel supply nozzles to form pilot flames by the downstream catalyst layer, which are above 1000 degrees C. and below 1500 degrees C. Combustible component having passed through the upstream catalyst layer is burned by the pilot flames.

2 Claims, 4 Drawing Sheets

COMBUSTOR FOR GAS TURBINE

This is a continuation application of Ser. No. 091,752 filed Sept. 1, 1987.

BACKGROUND OF THE INVENTION

The present invention relates to a catalytic combustor for gas turbines which aims at achieving low NOx combustion and, more particularly, to a catalytic combustor designed to enable fuel to be completely burned at low NOx emission in the entire range from the starting to the rated speed of the turbine.

As compared with the conventional gas-phase combustion system, the catalytic combustion can considerably reduce the NOx emission, can also reduce carbon monoxide and unburnt hydrocarbon, and can raise a combustion amount without increase in pressure loss at the combustor.

In the general catalytic combustion, the reaction rate of fuel in a low gas temperature range is determined by an inherent chemical reaction occurring at the catalyst surface, that is, is in a range of a reaction rate-determination where the mass transfer or heat transfer between the catalyst layer and the gas flow is made faster than the chemical reaction speed. For this reason, the temperature distribution and concentration distribution at the catalyst reaction surface become essentially equal to the temperature distribution or concentration distribution of the gas flow.

As the temperature range, in which the chemical reaction is rate-determined, is exceeded, a region is reached where the chemical reaction speed inherent to substance becomes substantially equal to its maximum speed. As this temperature is reached, transfer of the substance and heat is initiated to occur between the catalyst surface and the gas flow. In this state, the catalyst surface temperature is elevated to a level higher than the gas temperature and, accordingly, the fuel concentration in the vicinity of the catalyst surface is reduced to a level lower than that of the main flow.

As the temperature is further elevated, a region is reached where the reaction speed becomes fast abruptly in proportion to the rate of active substances diffused to the catalyst surface. In this region, since the active substances react immediately after they reach the catalyst surface, the active substance concentration becomes substantially equal to zero. That is, a diffusion rate-determining region is reached where it is the ruling or dominant condition how the active substances reach the catalyst surface. In the diffusion rate-determining region, the diffusion coefficient which the substances have is important. However, since the diffusion coefficient is not so much influenced by the temperature, the reaction speed is brought to a substantially constant level over the broad temperature range.

As the temperature further rises, the reaction speed rises abruptly and, finally, the gas-phase reaction is reached.

As will be understood from the foregoing description, it is advantageous to carry out the catalytic combustion at the level equal to or above the temperature at which the diffusion rate-determining region is reached. This is necessary in practical use.

On the other hand, when the reactivity under the above-described condition is considered, it is needless to say that necessary is the catalyst surface sufficient to receive the active substances diffused, in addition to the temperature condition under which the diffusion rate-determining region is reached. In the actual combustor, however, it is desirable that the combustor body is small in size, and it is not desirable to increase the amount of catalyst in order to obtain sufficient catalyst surface. Effective measures for reducing the overall device dimension are to combine the temperature range in which the diffusion rate-determining region is reached, and the higher temperature range with each other to design a combustor.

Moreover, the relationship between the fuel concentration and the catalytic reactivity is such that the reactivity rises if the fuel concentration is high. The reason for this is that higher the fuel concentration, the higher the heat generation temperature at the catalyst surface, to thereby elevate the gas temperature in the vicinity of the catalyst layer so that temperature reaches a region beyond the temperature range of the diffusion rate-determining stage, i.e., reaches a level at which the uniform gas-phase reaction proceeds. That is, a combustible range, when the actual catalytic combustor is supposed, is limited by the combustion efficiency on the fuel lean side, and is limited by the heat resistant temperature of the catalyst on the fuel too-rich side. Accordingly, the fuel concentration range satisfying both of them is extremely narrowed.

The relationship between the fuel concentration and the turbine load in the general gas turbine for generator is such that the fuel concentration is in a range of from 1% to 2% in the course of the starting of the turbine, and in a range of from 1% to 4% under the load condition. Thus, it is a great problem to achieve complete combustion by the use of catalyst in the region where the fuel concentration varies considerably.

In the prior art published, however, as disclosed in Japanese Patent Laid-Open Application No. 58-92729, emphasis of the consideration about change in fuel concentration is placed on the fuel too-rich side, i.e., on the catalyst heat resistant temperature, and no particular description is made to the combustion performance on the fuel lean side.

As represented by the aforesaid Japanese Patent Laid-Open Application No. 58-92729, an attempt is made in the prior art to use the combustor also when the fuel concentration varies, by arranging a plurality of catalysts different in heat resistant temperature from each other. However, no remarkable consideration is made on such important point that the individual catalysts have their respective inherent lower limits of completely combustible fuel concentration, and it is unavoidable for any catalysts that combustion is effected incompletely if the concentration is out of the above limits, so that the requisite gas temperature is not obtained. That is to say, the catalysts have their respective inherent lower limits of completely combustible fuel concentration, and in case of a combustor such as one for a gas turbine which is used in a broad range of fuel concentration, a problem is how a system is arranged to enable complete combustion in the entire range of the turbine load.

SUMMARY OF THE INVENTION

It is an object of the invention to provide a catalytic combustion apparatus which employs catalysts identical in heat resistant temperature with each other, or a small number of types of catalysts different in heat resistant temperature from each other, to enable complete combustion while restraining NOx generation in the entire range of a turbine load.

As described previously, catalysts have their respective inherent activation initiation temperatures and limits of heat resistant temperature. When the catalysts are used in the vicinity of their respective limits, the combustion efficiency is increased. When the catalysts are used in the vicinity of their respective activation initiating temperature, however, the combustion efficiency decreases. In other words, in such a condition that the combustion temperature is into the vicinity of the heat resistant temperature, the combustion efficiency decreases if the catalysts are used with the fuel concentration lower than that at which the heat resistant temperature is reached. The gas turbine is not necessarily used only with the fuel concentration at which the temperature reaches the level in the vicinity of the heat resistant temperature, but is frequently used under another conditions. In order to increase the combustion efficiency under these conditions, it may be considered to maintain the fuel concentration of a premixture supplied to the catalysts constant by adjustment of an amount of air. However, this results in complexity of the structure, and lacks in reliability.

In order to solve the above-discussed problems, and in order to form a system in which complete combustion is achieved in the entire range of a turbine load, an arrangement of the invention is such that unburnt hydrocarbon generated by combustion at low fuel concentration is re-burnt at a high temperature region provided on the downstream side, and the downstream high temperature region is obtained by catalytic combustion which is low in NOx generation. Specifically, catalyst layers are arranged in a plurality of stages in a direction of gas flow, premixtures of fuel and air are supplied respectively to the catalyst layers separately from each other, and a part of the fuel is controlled in such a manner that the concentration of the premixture supplied to the last stage of catalyst layer enables pilot flames to be formed in which gas temperature at the outlet of the catalyst is equal to or above 1000 degrees C, even if the turbine load varies.

According to the catalytic combustion apparatus constructed as described above, the last stage catalyst layer or a part thereof is caused to participate in combustion in the vicinity of the heat resistant temperature inherent to the catalyst, to thereby obtain high temperature gas from the combustion. Unburnt hydrocarbon produced upstream of the catalyst layer is re-burned by the high temperature gas. Thus, it is possible to achieve complete combustion. That is, the fuel supplied to the previous stage catalyst layer is decomposed by the catalyst volume requisite for partial reaction, into unburnt hydrocarbon and carbon monoxide, except for a case of a specific fuel concentration. When the gas decomposed into the high temperature unburnt hydrocarbon and the high temperature carbon monoxide passes through the subsequent stage catalyst layer, the reaction proceeds. However, the fuel which does not sufficiently react is re-burned by the pilot flames which are present downstream of the subsequent stage catalyst layer. The pilot flames obtained by the high temperature catalytic combustion provided at the subsequent stage can be controlled by adjustment of a part of the fuel supplied.

DETAILED DESCRIPTION

Figure 1:
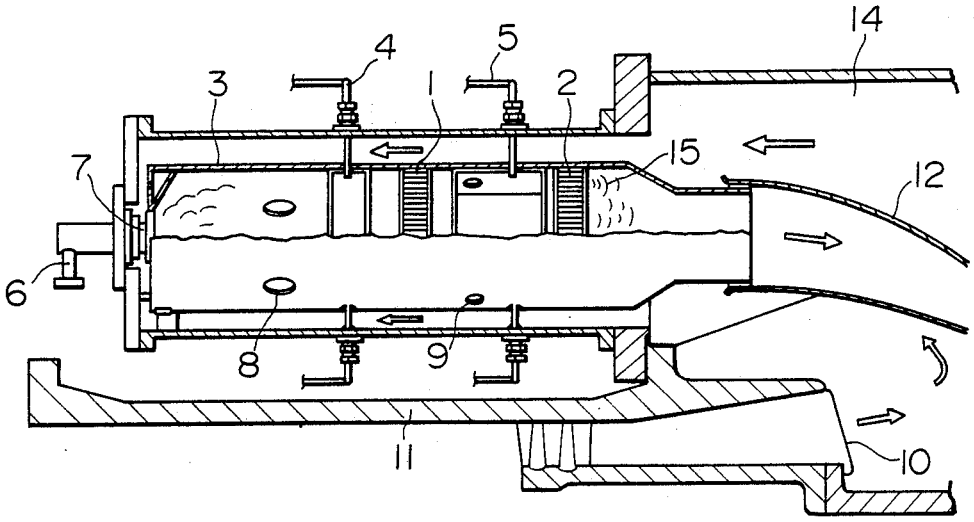
FIG. 1 is a schematic cross-sectional view showing an embodiment of the invention.

An embodiment of the invention will be described with reference to FIG. 1. A catalytic combustor comprises catalyst layers arranged in two stages, i.e., a front stage catalyst layer 1 and a rear stage catalyst layer 2 disposed at requisite intervals in the direction of gas flow. The catalyst layers are retained within a combustor liner 3. Provided as fuel supply ports are supply ports or nozzles 4 upstream of the front stage catalyst layer 1, supply ports or nozzles 5 upstream of the rear stage catalyst layer 2, and a supply port or nozzle 6 at a head of the combustor liner 3. Primary combustion air includes air supplied through swirlers from the periphery of a fuel nozzle 7 mounted to the combustor head, air supplied through bores 8 for dilution air to bring the gas temperature obtained due to diffusion combustion at the combustor head, to an appropriate level, air supplied through bores 9 for air to regulate the concentration of fuel to be supplied to the second stage catalyst layer, and so on. A tail cylinder 12 is connected to the downstream end of the combustor liner 3, for guiding combustion gas to a turbine inlet. The combustor liner 3 and the tail cylinder 12 are housed within a casing 11. Combustion air is supplied from a diffuser 10 at an outlet of a compressor, to an air reservoir 14. The air changes its flow direction at the air reservoir 14, flows through a space defined between the combustor liner 3 and the casing 11, and reaches the combustor head.

The operation of the combustor will next be described. As the gas turbine is started by an external power such as a diesel engine or the like, the rotational speed of the gas turbine increases gradually. As the rotational speed reaches a level on the order of 20% of the rated speed at no lead, fuel is supplied to the fuel nozzle 6 and is ignited by ignition plugs, not shown, so that the combustion due to diffusion combustion is started and the gas turbine enters the self sustaining. As the fuel increases gradually, the rotational speed of the turbine increases, and the air discharged from the compressor also increases gradually. As the rotational speed reaches a level in the vicinity of the rated speed at no load, the gas temperature at the inlet of the front stage catalyst layer 1 is brought to a level on the order of 500 degrees C. The high temperature gas heats the front and rear stage catalyst layers 1 and 2 so that they are elevated in temperature to a level of approximately 500 degrees C. As this state is reached, the starting of activation is made possible for both the front and rear stage catalyst layers 1 and 2. Then, the fuel is initiated to be supplied from the fuel nozzles 4 upstream of the front stage catalyst layer 1 and from the fuel nozzles 5 upstream of the rear stage catalyst layer 2. At this time, the fuel supplied from the fuel nozzles 5 forms the pilot flames 15 in which the combustion gas temperature at the rear stage catalyst layer locally reaches a level (1300 degrees C., for example) in the vicinity of the heat resistant temperature limit of the catalyst. In this case, the temperature of the pilot flames 15 is so set that the temperature has a value sufficient to re-burn unburnt hydrocarbon, and is brought to a level (1500 degrees C., in general) lower than that above which generation of NOx increases. The temperature adjustment is performed by regulating the amount of fuel supplied to the fuel nozzles 5 subsequently to be described.

In carrying-out of the invention, partitions may be provided in the catalyst layers so as to effectively burn the fuel in a locally controlled manner, i.e., in such a manner that the control of fuel concentration is not performed over the entirely of a broad cubit zone, to form the pilot flames. The partitions can be so arranged as to divide the catalyst layers radially or circumferentially. Fuel other than the fuel for forming the pilot flames is supplied from the fuel nozzles 4 or the fuel nozzle 6. Specifically, the premixture concentration upstream of the front stage catalyst layer 1 considerably varies from 1% to 3%, whereas the premixture concentration of the fuel supplied from the fuel nozzles 5 is maintained at a substantially constant value.

As the turbine load reaches about 50%, the gas temperature at the outlet of the front stage catalyst layer also rises and, therefore, the diffusion combustion for preheating the premixture upstream of the first stage catalyst layer becomes unnecessary. Thus, the fuel supply to the fuel nozzle 6 can be stopped.

The premixture concentration upstream of the front stage catalyst layer always varies due to change in load and the like, and is not necessarily used under the optimum temperature condition of the catalyst. For this reason, the combustion at the front stage catalyst layer 1 is not necessarily complete. However, the gas temperature at the outlet of the rear stage catalyst layer is positively used under the optimum temperature condition of the catalyst, and there is provided gas higher than 1000 degrees C. Consequently, unburnt component produced at the front stage catalyst layer 1 reacts while passing through the rear stage catalyst layer, and is finally burned completely.

Figure 2:
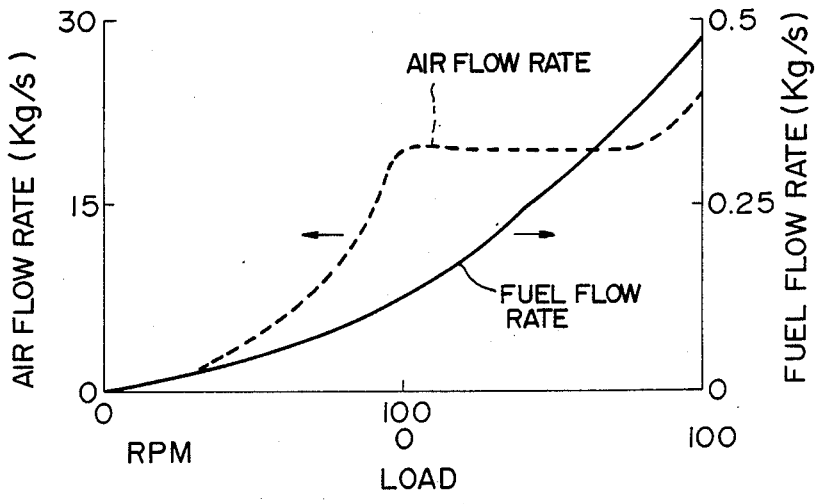
FIG. 2 is a graphical representation of the relationship between turbine load, and fuel flow rate and air flow rate.

FIG. 2 shows characteristics of a general gas turbine on air flow rate and fuel flow rate. The air flow rate increases substantially proportionally from the starting to the rated speed (r.p.m. 100%). Subsequent to the rated speed, the air flow rate is maintained at a constant value, even if the load increases.

Figure 3:
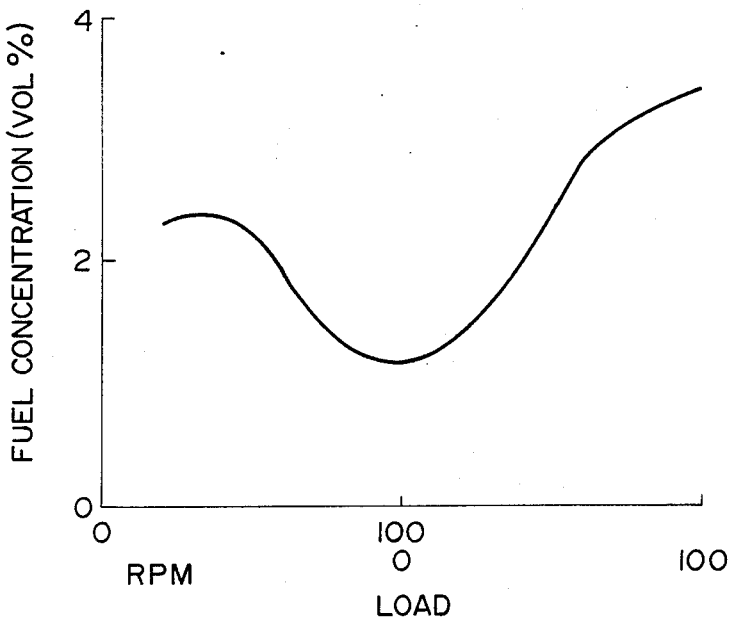
FIG. 3 is a graphical representation of the relationship between the turbine load and fuel concentration.

FIG. 3 shows values given by the fuel flow rate divided by the air flow rate, i.e., the fuel concentration. The fuel concentration decreases gradually from the starting to the rated speed, and again increases with increase in load.

Figure 4:
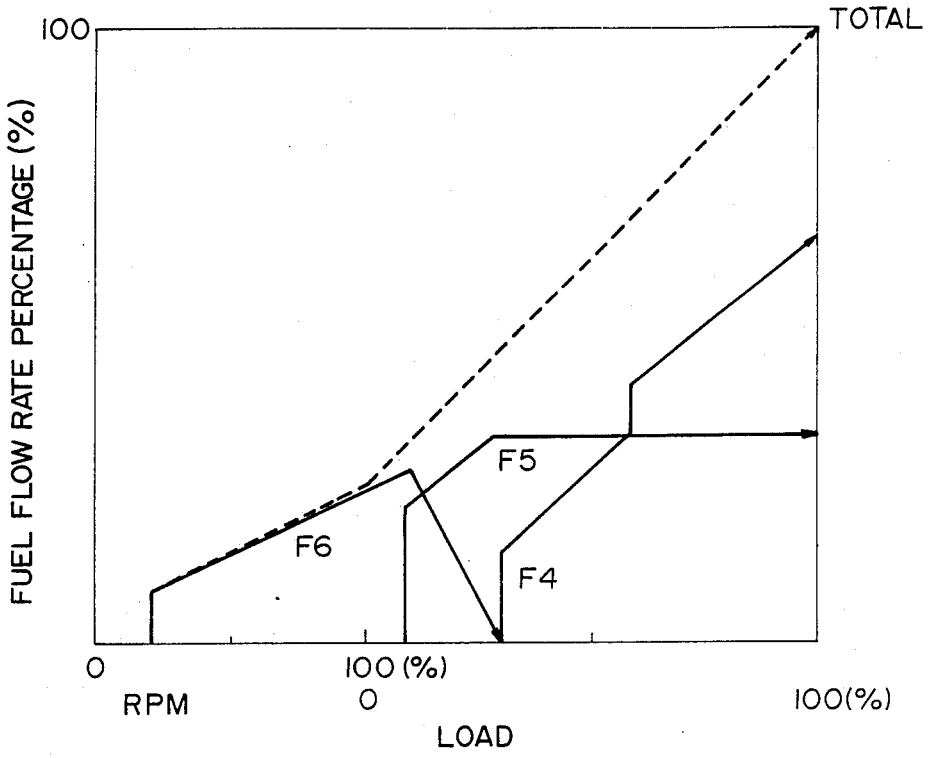
FIG. 4 is a graphical representation of an example of fuel control in the embodiment illustrated in FIG. 1.

An example of the control of fuel supply rate in the illustrated embodiment is shown in FIG. 4. A requisite amount of fuel is supplied only from the fuel nozzle 6 in the course of the turbine starting. As the gas temperature at the inlet of the front stage catalyst layer reaches a level required for activation of the catalyst, the fuel supply is started from the fuel nozzles 4 and 5, and the fuel from the fuel nozzle 6 is reduced gradually. In this stage, the concentration is controlled by the fuel supply amount from the fuel nozzles 5, to the level required to form the pilot flames. Since the air amount increases as the turbine load reaches a level higher than 80%, the fuel supply amount from the fuel nozzles 5 is increased by an amount corresponding to the increase in air amount.

In the embodiment of the invention, it was ascertained that even if the catalysts were used under concentrations other than the optimum fuel concentration inherent to the catalysts, the combustion efficiency higher than 99.99% was achieved in the entire range of the turbine load, and NOx emission was restrained to a level of few ppm or less. Moreover, since the above effects can be achieved by a small number of catalyst layers (two stages in the embodiment), the construction can be made simple, and the manufacturing cost required for construction of the catalyst layers can also be reduced. For example, in case where gas temperature on the order of 1300 degrees C. is obtained by catalysts different in utilizable temperature range from each other, about five stages of catalyst layers are required for the prior art, because the combustion range of each catalyst is on the order of at most ±5%. According to the embodiment of the invention, the two stages of catalysts are sufficient to obtain the above gas temperature.

Figure 5:
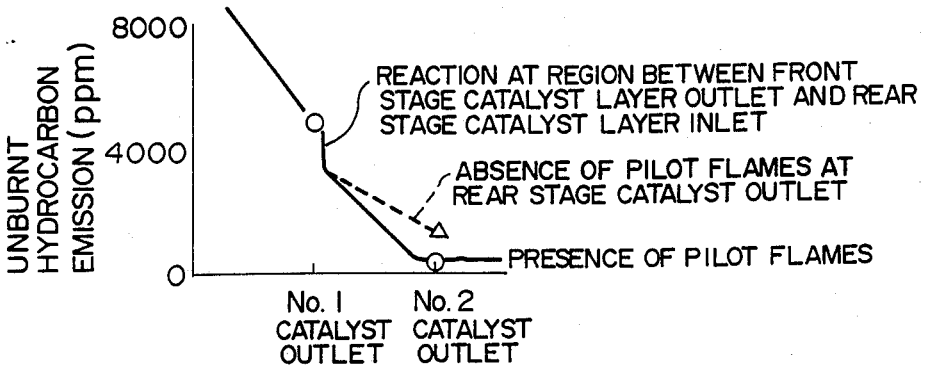
FIG. 5 is a graphical representation of recombustion effects due to pilot flames.

In FIG. 5, the abscissa represents the catalyst layers, and the ordinate represents the emission of unburnt hydrocarbon. It will be seen from FIG. 5 that the unburnt hydrocarbon discharged from the front stage catalyst layer is re-burnt by the pilot flames at the rear stage catalyst.

Figure 6:
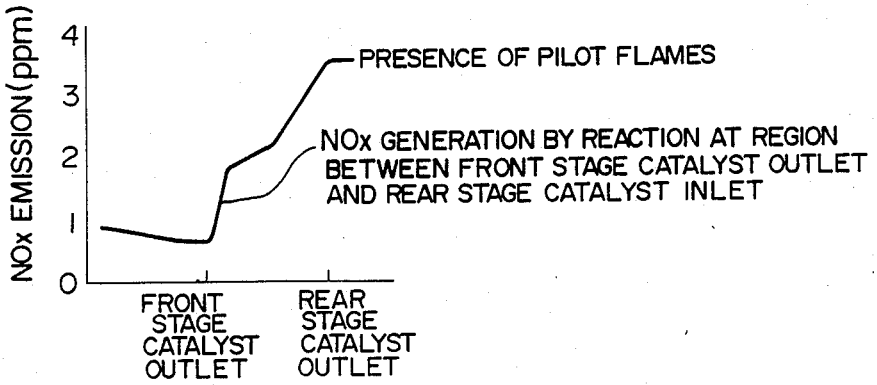
FIG. 6 is a graphical representation of an amount of NOx emission.
Figure 7:
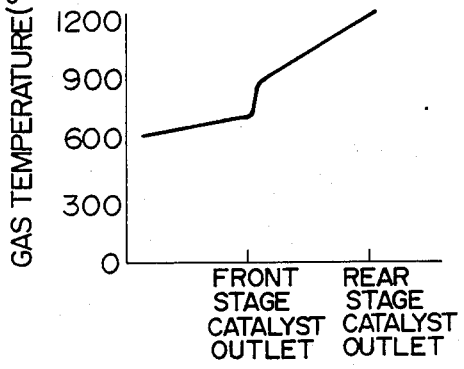
FIG. 7 is a graphical representation of gas temperature.

FIG. 6 indicates the NOx emission at that time, and FIG. 7 shows the gas temperature. The NOx emission is extremely reduced as compared with the prior art.

As described above, it is possible for the present invention to restrain NOx generation and to perform complete combustion over the entire range of the gas turbine load, by the use of catalysts having the same kind of heat resistant temperature or a small number of kinds of heat resistant temperatures.

What is claimed is:

1. A catalytic combustor for a gas turbine comprising:

a combustor liner having at an upstream section a head portion provided with a fuel nozzle and at a downstream section a rear portion provided with a tail cylinder;

stages of catalyst layers retained in said combustor liner between said head portion and said rear portion at a predetermined spaced interval in a direction of gas flow in said combustor liner;

a fuel supply nozzle disposed upstream of each of said catalyst layers;

first control means operatively associated with the fuel supply nozzle means most proximate the tail cylinder controlling flow rate of fuel therethrough so that a temperature level at the catalyst layer most proximate the tail cylinder is kept not lower than about 1000° C. and not higher than about 1500° C. independently of a load on the gas turbine; and second control means operatively associated with the fuel supply nozzle most proximate the head portion controlling flow rate of fuel therethrough in accordance with the load on the gas turbine.

2. A catalytic combustor as defined in claim 1, wherein the catalyst layer most proximate the tail cylinder employs catalyst higher in heat resistant temperature than that of the catalyst layer most proximate the head portion.

* * * * *